United States Patent [19]

Leeper

[11] Patent Number: 4,654,914

[45] Date of Patent: Apr. 7, 1987

[54] SIDE AND HEEL LASTING MACHINE

[75] Inventor: Alan L. Leeper, Nashua, N.H.

[73] Assignee: International Shoe Machine Corporation, Nashua, N.H.

[21] Appl. No.: 850,785

[22] Filed: Apr. 11, 1986

[51] Int. Cl.[4] ..... A43D 21/12; A43D 21/16; A43D 21/00

[52] U.S. Cl. ..... 12/10.5; 12/12.5; 12/14.5

[58] Field of Search ..... 12/14.5, 12.5, 12.3, 12/10, 10.1, 12, 10.5, 9, 8.8, 8.3

[56] References Cited

U.S. PATENT DOCUMENTS

| | | | |
|---|---|---|---|
| Re. 30,646 | 6/1981 | Vornberger et al. | 12/10.5 |
| 3,082,448 | 3/1968 | Rockwell, Jr. | 12/12.3 |
| 3,399,411 | 9/1968 | Fisk | 12/10.1 |
| 3,444,571 | 5/1969 | Harriman et al. | 12/10.5 |
| 4,499,622 | 2/1985 | Garner | 12/14.5 |
| 4,553,281 | 11/1985 | Vornberger | 12/10.5 |
| 4,593,423 | 6/1986 | Clarkson et al. | 12/12 |

*Primary Examiner*—Henry S. Jaudon
*Assistant Examiner*—Steven N. Meyers
*Attorney, Agent, or Firm*—Robert Shaw

[57] ABSTRACT

A side and heel lasting machine that serves to adhere the upstanding unwiped side and heel margin of a shoe upper assembly, which assembly includes a last with an insole on the last bottom and an upper draped about the last. The toe portion of the upper assembly has previously been wiped to the periphery region of the assembly insole. A pair of pincers, one disposed at each side of the upper of the assembly, grasps the upstanding unwiped margin and draws it upwardly, inwardly and forwardly (i.e., towards the toe thereof) to fit it snugly about the last. Lasting pads are employed to keep the unwiped margin in position during application of adhesive from nozzles that are spring loaded to press outwardly and track the upstanding unwiped margin when adhesive is applied in the region between the insole and the margin. The upstanding side and heel margin is then wiped onto the insole.

4 Claims, 6 Drawing Figures

SIDE AND HEEL LASTING MACHINE

The present invention relates to machines to last the sides and heel of a shoe or other footwear assembly.

Attention is called to the U.S. Pat. No. Re. 30,646 (Vornberger et al) and the further art cited in the patent as well as U.S. Pat. No. 4,553,281 (Vornberger).

Hereinafter the invention is described mostly in the context of a lasting machine for shoes. In the typical shoe fabrication process, as is discussed in great detail in the above-noted patents, a shoe upper assembly, consisting of a last having an insole located on its bottom and an upper mounted thereon, is first toe lasted and then side and heel lasted. Typically, in the toe lasting operation the upper margin is adhered to the insole from the toe to the ball portion of the assembly; then the upper margin extending heelwardly from the wiped portion is cemented onto the insole. It is the latter operation that is performed on the machine herein disclosed and is called side and heel lasting. Typically, in the present-type machine, an adhesive is applied as a liquid ribbon on the insole near its periphery or edge, or, in some machines, onto the upwardly directed margin, by nozzles which track the upwardly directed margin during application of the adhesive. The nozzles are spring loaded (typically by an air spring) to press outwardly against the upper margin and to track the margin. Lasting is achieved by the wiping action of a lasting tool which presses the upper margin inwardly and downwardly upon the insole, squeezing the adhesive therebetween to adhere the margin onto the insole. The heel region is wiped by heel wipers. At times wrinkles form at the shank or brestline of the shoe during lasting. It is an objective of the present invention to remove those (and other wrinkles) during lasting.

This and still further objectives are addressed hereinafter.

The foregoing objectives are attained, generally, in a machine, operable on a footwear assembly having an insole located at its bottom and an upper mounted thereon with the toe portion of the upper margin wiped against and secured to the insole and unwiped portions of the upper extending heelwardly of the wiped margin portion, which unwiped margin portions extend upwardly at an open angle to the insole, for applying adhesive in the region between the unwiped margin portions and the corresponding portions of the insole at said region. The machine includes a footwear assembly support for supporting the footwear upper assembly with the insole directed upwards; a nozzle mechanism spaced outwardly from and facing the insole and mounted for motion toward and away from the insole as well as transverse longitudinal movement with respect to the insole, the nozzle mechanism being operable to apply adhesive into said region; and a pincers mechanism to grasp the unwiped margin portions at each side of the upper between the heel portion or area and the toe portions or area and operable to apply upward drafting forces on the upper margin of the shank or brestline thereof as well as forward drafting forces thereon, to draw the upper snugly about the last.

The invention is hereinafter described with reference to the accompanying drawing in which.

Figure 1:
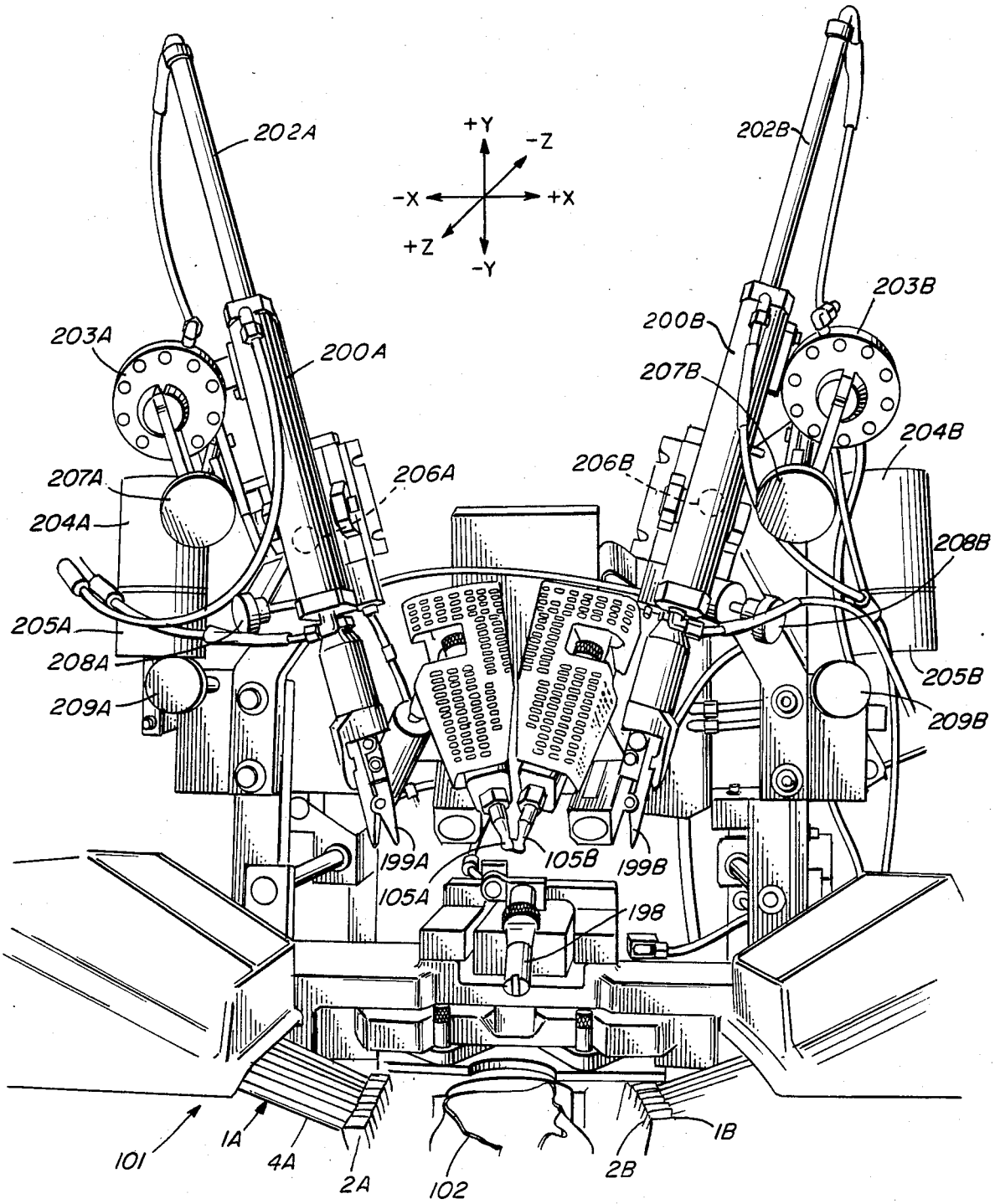
FIG. 1 is an isometric view of a machine that embodies the present invention, looking downward on the machine from the front thereof and slightly to the right of its center to show a pair of pincers and a shoe upper assembly with an upstanding margin.
Figure 2:
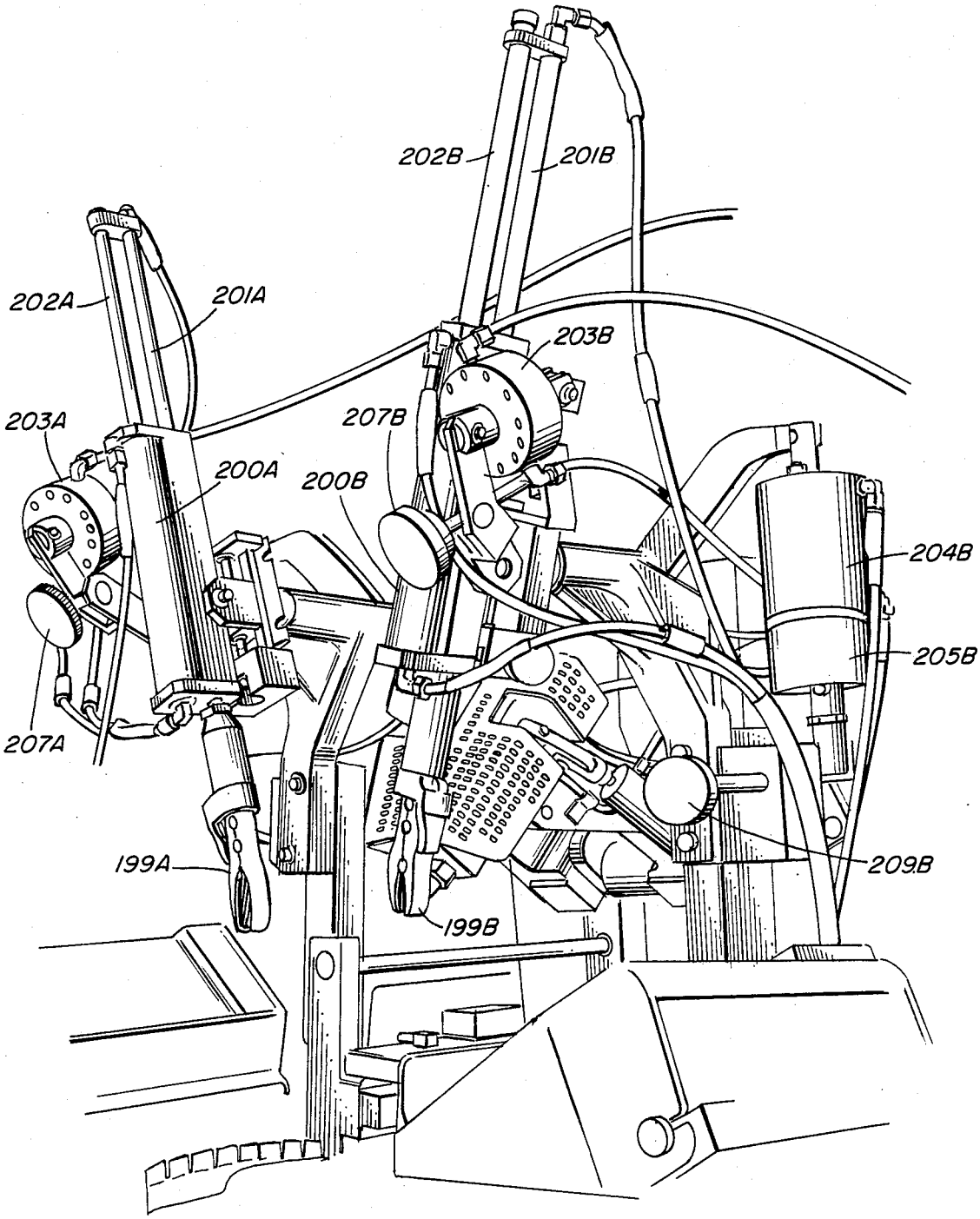
FIG. 2 is an isometric view taken to the right of the view in FIG. 1.

The operator is intended to stand in front of the machine labeled 101 in FIG. 1 looking in the minus Z direction. Directions extending toward the operator (i.e., plus Z direction) will be designated as "forward" and directions extending away from the operator will be designated as "rearward". The front of the machine is closest to the operator and the back of the machine is furthermost from the operator.

Figure 6:
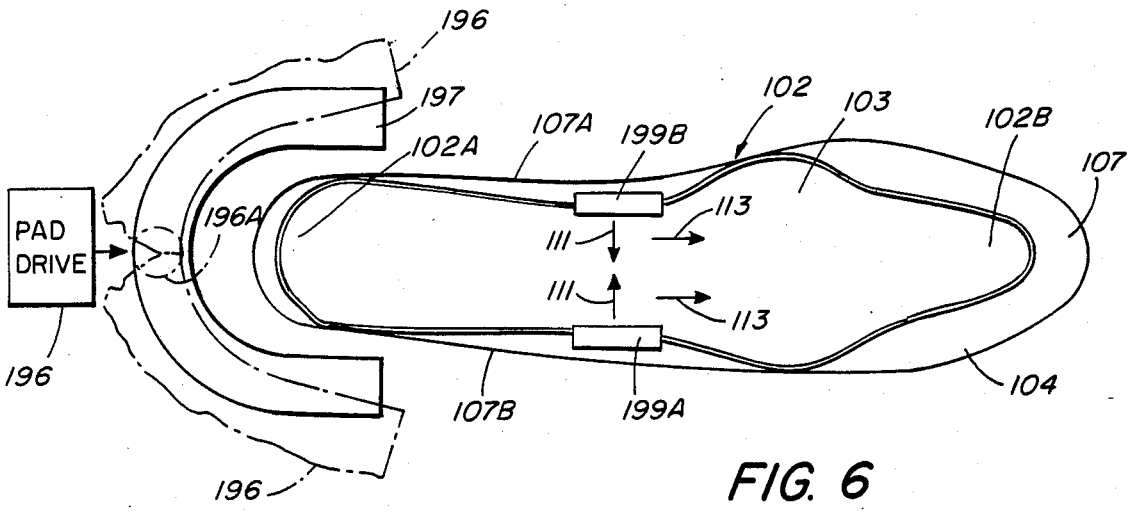
FIG. 6 is a top view of the shoe upper assembly of FIG. 5, partly diagrammatic in form, and with some machine parts not shown in FIG. 5.
Figure 5:
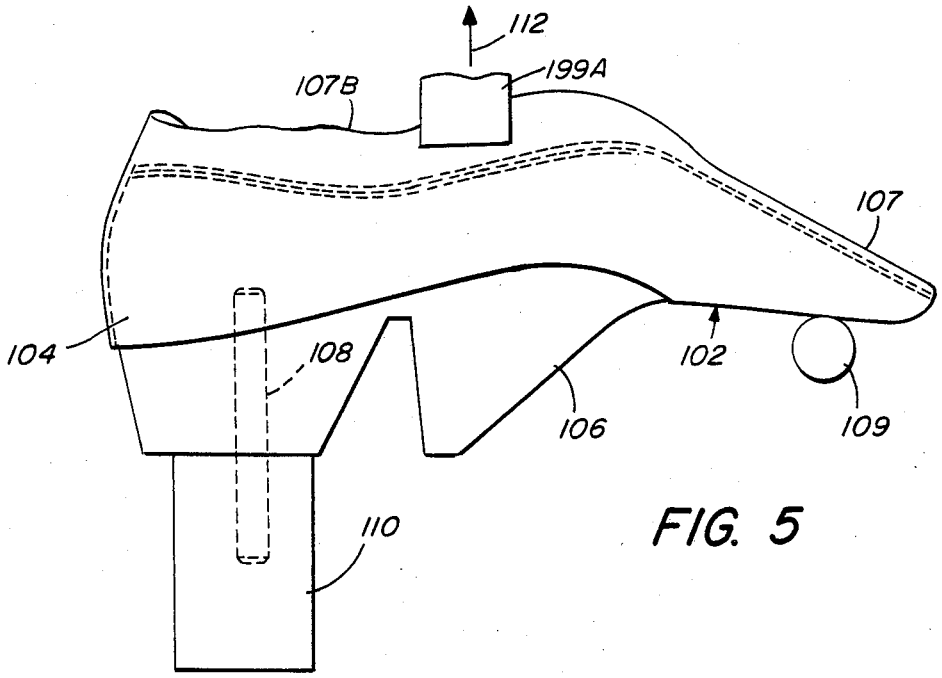
FIG. 5 is a side view of the shoe upper assembly of FIG. 1 and machine parts needed to secure the upper assembly to the machine during lasting.

The machine 101 is operable on a shoe or other footwear upper assembly 102 in FIGS. 5 and 6, that includes a last 106 having an insole 103 located at its bottom and an upper 104 mounted thereon with the toe portion 107 of the upper margin wiped against and secured to the insole. The unwiped margin portions marked 107A and 107B of the upper extend upward at an open angle to the insole. Nozzles 105A and 105B in FIG. 1 apply adhesive as a liquid ribbon in region between the unwiped margin portions and the corresponding portions of the insole periphery, that is, adhesive is applied onto the insole at or near its periphery or adhesive is applied onto the upstanding unwiped margin in the vicinity and above the insole periphery (see the Vornberger '281 patent for details). Then the upstanding unwiped margin 107A and 107B is pressed down onto the insole squeezing the adhesive therebetween to adhere the margin to the insole. In order that the adhesive be correctly placed over the whole length of the unwiped margin portion, the nozzles 105A and 105B are spring loaded to press outwardly against the margin and track the margin as they move rearwardly from the ball of the upper assembly, along the sides thereof and thence to the heel. The nozzles 105A and 105B are initially spaced upwardly from and facing the insole 103; they are mounted for motion toward and away from the insole (±Y-direction), transverse (±X-direction) movement, the longitudinal (±z-direction) movement with respect to the insole.

The machine 101 includes a lasting tool operable to clamp the upper 104 against the last 106 and to apply light backup pressure against the unwiped margins (ie., 107A and 107B) to support the same, but nevertheless maintain the open angle between the unwiped margin portions and the insole to permit application of adhesive into the region between the unwiped margin portion and the corresponding adjacent portion of the insole. The lasting tool includes two lasting instrumentalities 1A and 1B in FIG. 1, each consisting, in the disclosed embodiment, of an inner lasting pad 2A and 2B, respectively, and an outer lasting pad 3A and 3B, respectively, in FIG. 3. Each lasting pad is made of an elastic, flexible and deformable material such as urethane. The top end of each inner lasting pad is formed into a plurality of relatively rigid segments $2A_1$ and $2B_1$ for the pads 2A and 2B, respectively. The top rigid segments of the outer pads 3A and 3B are marked $3A_1$ and $3B_1$ in FIG. 3. As described in detail in the Vornberger '281 patent, an actuator mechanism presses the relatively rigid segments $2A_1$, $3A_1$ etc., at each side of the footwear assembly 102 inwardly of the footwear assembly to press the upper tightly against the last 106 and to apply the light backup pressure while maintaining the open angle. The actuator mechanism, as described in the Vornberger '281 patent, maintains the lasting pads at one (i.e., lower) level when the adhesive is being applied and, subsequent to application of the adhesive, moves the two lasting instrumentalities 1A and 1B to the second (i.e., higher) level upwardly of the insole while simultaneously moving the rigid segments of the two inner lasting pads inwardly and over the insole in a wiping action to fold the margin onto the insole to press the adhesive between the margin and the insole to adhere the margin onto the insole. The combined upward movement and inward wiping action of the instrumentalities 1A and 1B serve, among other things, to stretch the upper 104 about the last 106. The actuator mechanism employs a wedge and wheel arrangement which gives steady and controllable upward forces to move the pads between the two levels. At the lower level during application of adhesive the pads are less likely to fold the margin onto the insole. The inwardly directed forces are applied by air-actuated finger cylinders (e.g., 4A in FIG. 1) upon the inner pads 2A and 2B and further air-actuated cylinders upon the outer pads 3A and 3B.

It has been found that in some situations the upper does not conform acceptably to the last and that other measures need be taken. In accordance with the present teaching a pair of pincers (or grippers) 199A and 199B in FIG. 6 grasp the unwiped margin portions 107A and 107B in FIG. 6, of the upper assembly 102 at each side of the upper assembly in the area (or region) between the heel portion labeled 102A and the toe portion 102B thereof. The pincers 199A and 199B are operable to apply a combination of upward drafting forces (i.e., in the direction of the arrow marked 112 in FIG. 5), forward or toeward drafting forces (i.e., in the direction of the arrows marked 113 in FIG. 6) and inward drafting forces (i.e., in the direction of the arrows marked 111 in FIG. 6). The combination of forces serves to wrap the upper 104 closely about the last 106 at all parts thereof. More specifically, the combination of forces draws the upper inwardly toward the longitudinal axis of the upper assembly and about the shank or breastline area of the last 106 (i.e., in the region between the heel portion and the toe portion of the upper assembly 102), as well as to draw the heel portion of the upper assembly 102 about and in conformance with the heel portion of the last 106. It will be noted, as later explained, that the various forces are applied by double-acting air cylinders that have infinite variability. Hence the combination of upward, forward and inward forces are infinitely variable by the various air cylinders discussed below. Sequencing of the machine 101 is now taken up.

A last pin 108 in FIG. 5 receives the inverted upper assembly which has a thimble hole for that purpose. The assembly 102 is maintained in position during subsequent operations by the pin 108 which is rotated clockwise by a spindle 110 in FIG. 5 to press the toe of the assembly 102 onto a toe rest 109. At about the same time a hold-down 198 in FIG. 1 presses downward on the insole to effect firm positioning of the assembly 102 with respect to the machine 101. A heel pad 197 in FIG. 6 is moved to the right by a pad drive 196, thereby wrapping the pad 197 about the heel portion of the assembly 102. The pincers 199A and 199B move downward from the position in FIG. 1 to the position in FIG. 3 and grasp the margins 107A and 107B in FIG. 6 and stretch the upper in the manner discussed above and as shown in FIG. 4. At that juncture the lasting pads 2A, 2B, 3A and 3B move into contact with the upper assembly 102 to press the upper at the shank or breastline firmly against the last and apply the before-mentioned back-up pressure. The pincers 199A and 199B release their hold on the upper margins and return to the position. shown in FIG. 1, which position is above the upper assembly 102 and is out of the path of travel of the adhesive nozzles 105A and 105B as those nozzles move from the position in FIG. 1 downwardly to the vicinity of the insole 103. The movement of the nozzles, as is discussed in detail in the Vornberger '281 patent, is along all three X, Y and Z directions. The nozzles apply an adhesive in the manner discussed and then retract to the position in FIG. 1. At that juncture the heel portion 102A is wiped by heel wipers 196 in FIG. 6, that pivot inwardly at 196A. At the same time, the inner lasting pads 2A and 2B move inwardly and over the edge of the upper assembly to press the margins 107A and 107B downward onto the insole 103 to achieve wiping thereof, as discussed in the Vornberger '281 patent. The upper assembly 102 is then removed and another like assembly is installed. Structures that move the pincers 199A and 199B are now described.

Figure 3:
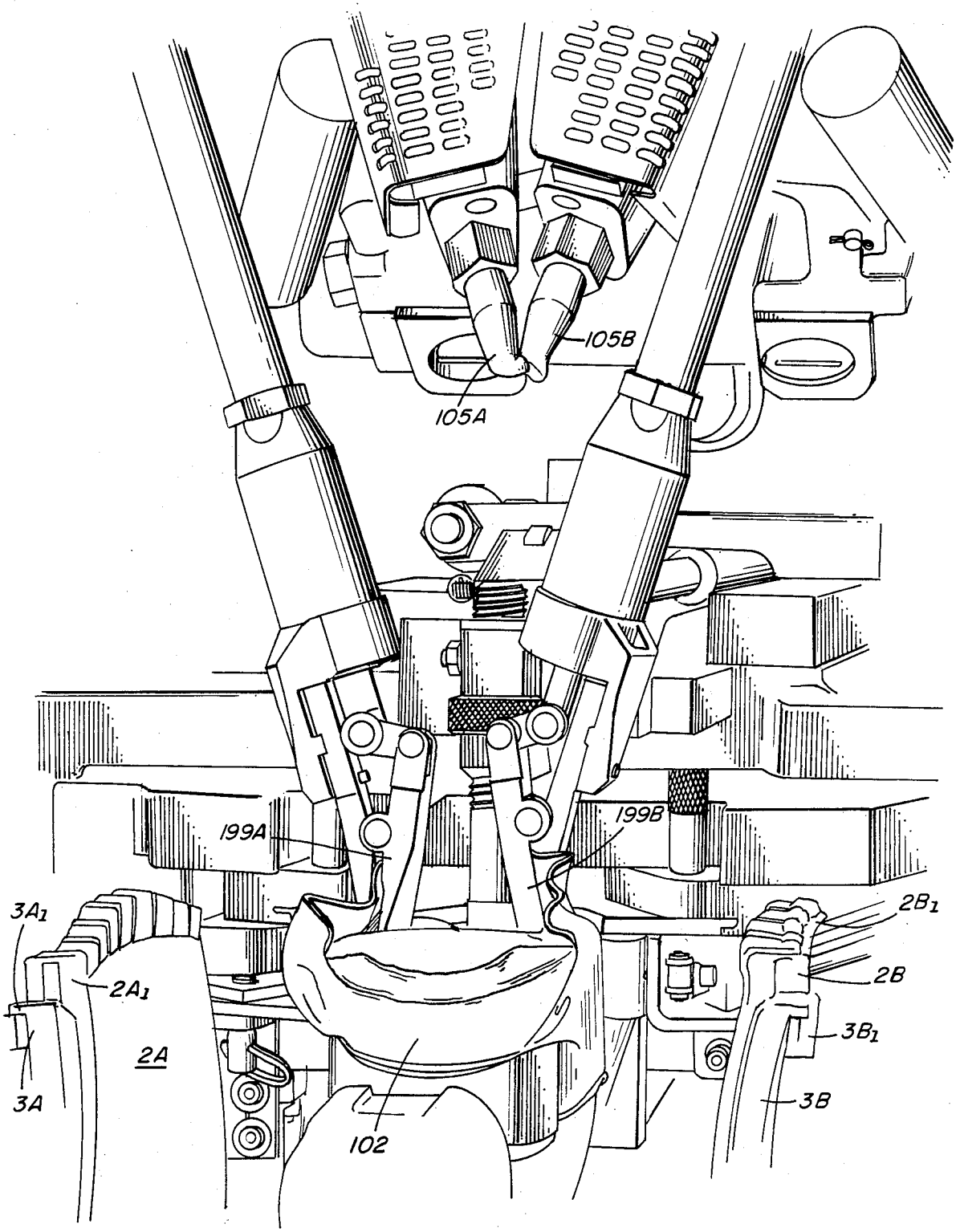
FIG. 3 is a close-up right front view, like the view in FIG. 1, but showing the pincers grasping the upstanding margin at the shank portion thereof.
Figure 4:
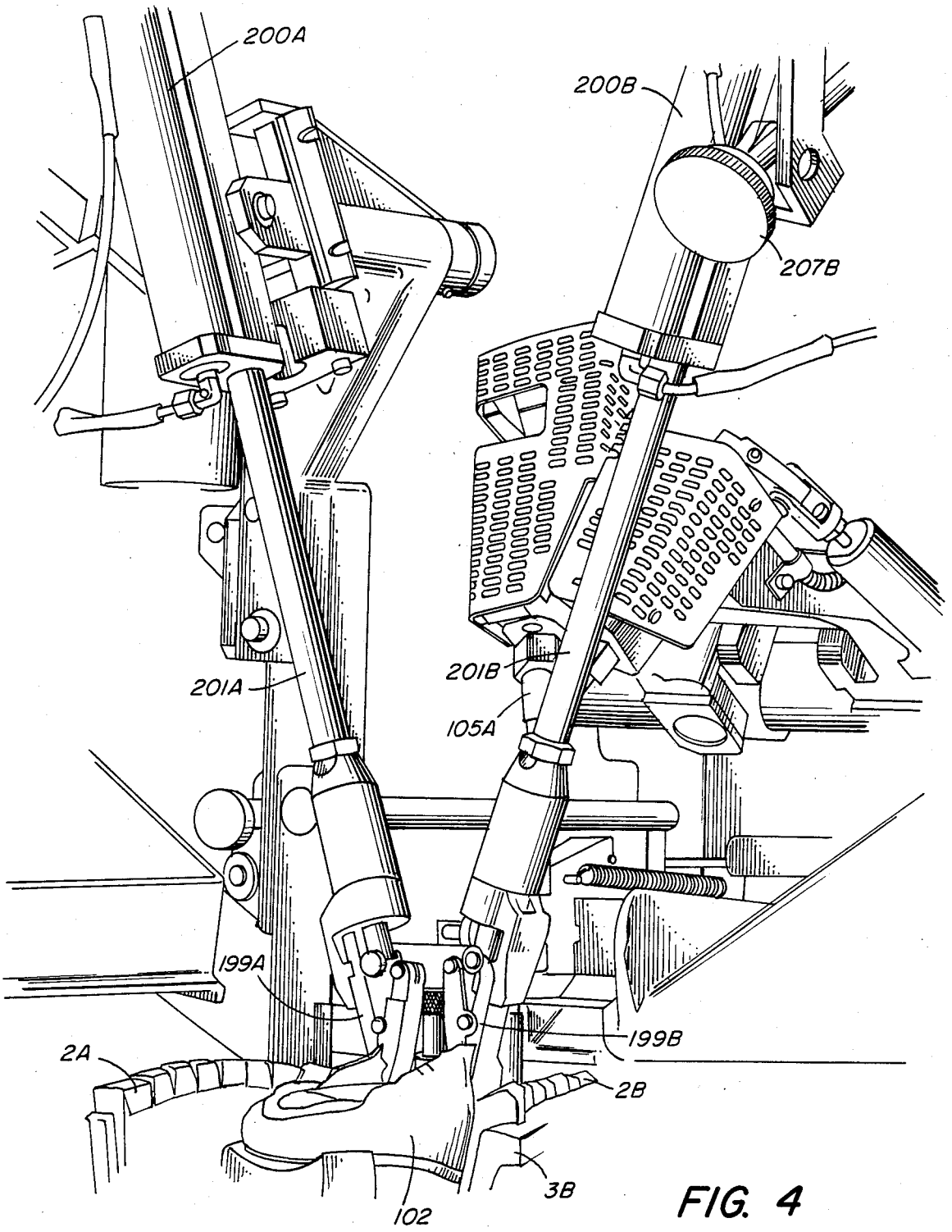
FIG. 4 is an isometric view, from the right, showing the margin of the upper being drawn upwardly.

Double-acting cylinders 200A and 200B move shafts 202A and 202B up and down, driving shafts 201A and 201B which, in turn, move the pincers 199A and 199B respectively from the position in FIG. 1 to the position shown in FIG. 3; the same cylinders 200A and 200B apply the upward force in the 112 direction on the upper margins 107A and 107B. The up-down pincers position is controlled by adjustment knobs 208A and 208B. Double-acting air cylinders 203A and 203B apply the forwardly directed (i.e., in the direction of the arrows 113 in FIG. 6), the fore-aft pincers position being controlled by knobs 207A and 207B. Double-acting air cylinders 204A and 204B pivot the pincers about pivots 206A and 206B to achieve positioning in the transverse or X-direction. The cylinders marked 205A and 205B provide the inwardly-directed drawing forces in the direction of the arrows 111 in FIG. 6, again about the pivots 206A and 206B; the inward pincers position is controlled by knobs 209A and 209B. All cylinder forces are controlled by regulated air pressure.

The various air cylinders to achieve the movements of the pincers 199A and 199B, as noted, have infinite control of the various drafting forces applied. Drafting is done before the adhesive is applied and before the lasting pads are pressed against the upper 104; hence, a fine fit can be achieved between the upper and the last, including at the heel region where upper shapes can vary significantly from upper to upper. The heel region is multi-layered and hence the amount at the 111-directed force is important.

Further modifications of the invention herein disclosed will occur to persons skilled in the art and all such modifications are deemed to be within the scope of the invention as defined by the appended claims.

What is claimed is:

1. A machine operable on a footwear assembly comprising a last having an insole located at its bottom and an upper mounted thereon with the toe portion of the upper margin wiped against and secured to the insole and unwiped portions of the upper extending heelwardly of the wiped margin, which unwiped margin portions extend upwardly at an open angle to the insole, for applying adhesive in the region between said unwiped margin portions and the corresponding portions of the insole at said region, said machine comprising:

a footwear assembly support for supporting the footwear assembly with the insole directed upwards;

nozzle means spaced upwardly from and facing said insole and mounted for motion toward and away from the insole as well as transverse and longitudinal movement with respect to the insole, said nozzle means being operable to apply adhesive into said region;

a lasting tool operable to clamp the upper tightly against the last and to apply light backup pressure against the unwiped margin to support the same, but nevertheless maintaining the open angle between the unwiped margin portions and the insole to permit application of adhesive into said region, said lasting tool comprising two lasting instrumentalities each comprising an inner lasting pad, one inner lasting pad being disposed at each side of the footwear assembly, each lasting pad being made of an elastic, flexible and deformable material, one end of each inner lasting pad being formed into a plurality of relatively rigid segments;

actuator means to press the rigid segments of the inner lasting pad at each side of the footwear assembly inwardly of the footwear assembly to press the upper tightly against the last and to apply said light backup pressure while maintaining said open angle, which actuator means moves the relatively rigid segments of the two inner lasting pads inwardly and over the insole in a wiping action to fold the margin onto the insole to adhere the margin onto the insole; and pincer means to grasp the unwiped margin portions of the footwear assembly at each side of the upper assembly in the area between the heel portion of the footwear assembly and the toe portion thereof operable to apply an upward drafting force on the upper at said unwiped margin portions as well as a forward drafting force and an inward drafting force thereon, to draw the upper snugly about the the last, after which the upper is wiped.

2. A machine according to claim 1 which the pincers means comprises two pincers, one disposed at each side of the upper assembly and each adapted to grasp the upstanding unwiped margin portions at the respective side and to draw the respective unwiped margin portions upwardly and forwardly.

3. A machine that is operable on a footwear assembly comprising a last having an insole located at its bottom and an upper mounted thereon with the toe portion of the upper margin wiped against and secured to the insole and unwiped margin portions of the upper extending heelwardly of the wiped margin portion, which unwiped margin portions extend upwardly at an open angle to the insole, said machine comprising:

a footwear assembly support for supporting the footwear assembly with the insole directed upwardly;

nozzle means spaced upwardly from and facing said insole and mounted for motion toward and away from the insole as well as transverse and longitudinal movement with respect to the insole, said nozzle means being operable to apply adhesive into the region between the unwiped margin portions and the insole; and pincer means to grasp the unwiped margin portions of the footwear assembly at each side of the upper in the area between the heel portion of the footwear assembly and the toe portion thereof, said pincers means being operable to apply upward drafting force on the upper at said unwiped margin portions as well as a forward drafting force and an inward drafting force thereon, to draw the upper snugly about the last, after which the upper is wiped.

4. A machine according to claim 3 in which the pincers means includes means to achieve variable control of the drafting forces applied to the upper.

* * * * *